US009708862B2

(12) United States Patent
Hallundbæk et al.

(10) Patent No.: US 9,708,862 B2
(45) Date of Patent: Jul. 18, 2017

(54) ANNULAR BARRIER WITH AXIAL FORCE MECHANISM

(75) Inventors: Jørgen Hallundbæk, Græsted (DK); Ricardo Reves Vasques, Holte (DK)

(73) Assignee: Welltec A/S, Allerød ( * ) Notice: Subject to any disclaimer, the term of this patent is extended or adjusted under 35 U.S.C. 154(b) by 580 days.

(21) Appl. No.: 14/344,764

(22) PCT Filed: Sep. 12, 2012

(86) PCT No.: PCT/EP2012/067822

§ 371 (c)(1),
(2), (4) Date: Mar. 14, 2014

(87) PCT Pub. No.: WO2013/037817

PCT Pub. Date: Mar. 21, 2013

(65) Prior Publication Data

US 2014/0190708 A1 Jul. 10, 2014

(30) Foreign Application Priority Data

Sep. 13, 2011 (EP) ..... 11181103

(51) Int. Cl.
*E21B 33/127* (2006.01)
*E21B 17/00* (2006.01)

(52) U.S. Cl.
CPC ..... *E21B 17/00* (2013.01); *E21B 33/1277* (2013.01)

(58) Field of Classification Search
CPC . E21B 33/127; E21B 33/1277; E21B 33/1243
(Continued)

(56) References Cited

U.S. PATENT DOCUMENTS 2,828,823 A 4/1958 Mounce
3,053,322 A * 9/1962 Kline ..... E21B 33/14 166/187

(Continued)

FOREIGN PATENT DOCUMENTS

CN 2674079 Y 1/2005
CN 1708631 A 12/2005

(Continued)

OTHER PUBLICATIONS

International Search Report dated Nov. 12, 2012.

(Continued)

*Primary Examiner* — Kenneth L Thompson
(74) *Attorney, Agent, or Firm* — Nixon & Vanderhye P.C.

(57) ABSTRACT

The present invention relates to an annular barrier to be expanded in an annulus between a well tubular structure and an inside wall of a borehole downhole for providing zone isolation between a first zone and a second zone of the borehole. The annular barrier comprises a tubular part extending in a longitudinal direction for mounting as part of the well tubular structure; an expandable sleeve surrounding the tubular part and defining a space being in fluid communication with an inside of the tubular part; a first fluid passage for letting fluid into the space to expand the sleeve; and a connection unit comprising a connection part slidably connected with the tubular part, a first end of the expandable sleeve being connected with the connection part, wherein the connection unit further comprises a stationary part fixedly connected with the tubular part and an actuation mechanism adapted to induce an axial force on the first end of the expandable sleeve.

10 Claims, 9 Drawing Sheets

(58) Field of Classification Search
USPC ..... 166/387, 187; 277/331, 333
See application file for complete search history.

(56) References Cited

U.S. PATENT DOCUMENTS

| | | | | |
|---|---|---|---|---|
| 3,208,532 | A * | 9/1965 | Chenoweth | E21B 33/127 166/196 |
| 3,853,177 | A * | 12/1974 | Mott | E21B 21/10 166/184 |
| 4,403,660 | A | 9/1983 | Coone | |
| 5,277,253 | A * | 1/1994 | Giroux | E21B 33/128 166/187 |
| 5,499,687 | A * | 3/1996 | Lee | E21B 21/003 166/154 |
| 7,591,321 | B2 | 9/2009 | Whitsitt et al. | |
| 8,714,273 | B2 * | 5/2014 | Lynde | E21B 33/1212 166/179 |
| 2002/0189696 | A1 | 12/2002 | Simpson et al. | |
| 2004/0055758 | A1 | 3/2004 | Brezinski et al. | |
| 2004/0182582 | A1 | 9/2004 | Bosma et al. | |
| 2006/0090905 | A1 | 5/2006 | Brennan, III et al. | |
| 2006/0260820 | A1 | 11/2006 | Whitsitt et al. | |
| 2015/0330181 | A1 * | 11/2015 | Budde | E21B 33/146 166/289 |

FOREIGN PATENT DOCUMENTS

| | | | |
|---|---|---|---|
| RU | 2289014 | C2 | 12/2006 |
| RU | 2384692 | C2 | 3/2010 |
| SU | 691553 | A1 | 4/1958 |

OTHER PUBLICATIONS

Written Opinion of the International Searching Authority dated Nov. 12, 2012.

International Preliminary Report on Patentability issued in International Application No. PCT/EP2012/067822 dated Mar. 18, 2014.

* cited by examiner

ANNULAR BARRIER WITH AXIAL FORCE MECHANISM

This application is the U.S. national phase of International Application No. PCT/EP2012/067822 filed 12 Sep. 2012 which designated the U.S. and claims priority to EP 11181103.0 filed 13 Sep. 2011, the entire contents of each of which are hereby incorporated by reference.

FIELD OF THE INVENTION

The present invention relates to an annular barrier to be expanded in an annulus between a well tubular structure and an inside wall of a borehole downhole for providing zone isolation between a first zone and a second zone of the borehole, the annular barrier comprising a tubular part extending in a longitudinal direction for mounting as part of the well tubular structure; an expandable sleeve surrounding the tubular part and defining a space being in fluid communication with an inside of the tubular part; a first fluid passage for letting fluid into the space to expand the sleeve; and a connection unit comprising a connection part slidably connected with the tubular part. Further, the present invention relates to a system comprising an annular barrier and a method of expanding an annular barrier.

BACKGROUND ART

In wellbores, annular barriers are used for different purposes, such as for providing a barrier for flow between an inner and an outer tubular structure or between an inner tubular structure and the inner wall of the borehole. The annular barriers are mounted as part of the well tubular structure. An annular barrier has an inner wall surrounded by an annular expandable sleeve. The expandable sleeve is typically made of an elastomeric material, but may also be made of metal. The sleeve is fastened at its ends to the inner wall of the annular barrier.

Multiple annular barriers may be used to seal off a zone between an inner and an outer tubular structure or a well tubular structure and the borehole. A first annular barrier is expanded on one side of the zone to be sealed off, and a second annular barrier is expanded on the other side of that zone, whereby the zone is sealed off.

An annular barrier may be set using a pressurised fluid which is injected into the well or into a limited part of the well. Hereby, the expandable sleeve of the annular barrier is expanded to engage with an outer tubular structure or the inner wall of the borehole. The pressure envelope of a well is governed by the burst rating of the tubular and the well hardware etc. used within the well construction. When the expandable sleeve is expanded by increasing the pressure within the well, the burst rating of a well defines the maximum pressure that can be applied. It is desirable to minimise the expansion pressure required for expanding the sleeve to minimise the exposure of the well to the expansion pressure.

To reduce the expansion pressure of the annular barrier, the thickness of the expandable sleeve may be decreased. However, this impairs the strength of the expandable sleeve and the maximum expanded size of the sleeve. Further, the sleeve may collapse or rupture before the desired expanded size of the sleeve is reached. A frequently occurring reason for ruptures of expandable sleeves is inexpedient thinning of the sleeve material during expansion. Thinning of the sleeve material is an important property of the expandable sleeve, but too much thinning, e.g. in a local region of the sleeve, will cause the annular barrier to malfunction.

SUMMARY OF THE INVENTION

It is an object of the present invention to wholly or partly overcome the above disadvantages and drawbacks of the prior art. More specifically, it is an object to provide an improved annular barrier wherein inexpedient thinning of the sleeve is avoided.

The above objects, together with numerous other objects, advantages, and features, which will become evident from the below description, are accomplished by a solution in accordance with the present invention by an annular barrier to be expanded in an annulus between a well tubular structure and an inside wall of a borehole downhole for providing zone isolation between a first zone and a second zone of the borehole, the annular barrier comprising:

- a tubular part extending in a longitudinal direction for mounting as part of the well tubular structure,
- an expandable sleeve surrounding the tubular part and defining a space being in fluid communication with an inside of the tubular part,
- a first fluid passage for letting fluid into the space to expand the sleeve,
- and a connection unit comprising a connection part slidably connected with the tubular part, wherein the connection unit further comprises a stationary part fixedly connected with the tubular part and an actuation mechanism adapted to induce an axial force on the first end of the expandable sleeve, whereby the connection part is displaced in the longitudinal direction towards a second end of the expandable sleeve connected with the tubular part.

An advantage in this respect is that inexpedient thinning of the expandable sleeve is avoided by simultaneously expanding the expandable sleeve by injecting a hydraulic fluid into the space defined by the expandable sleeve and displacing the connection part to move one end of the expandable sleeve towards the other end.

In one embodiment, the connection part may constitute part of the actuation mechanism.

The annular barrier as described above may further comprise two connection units each comprising a connection part connected to a first and a second end of the expandable sleeve, respectively.

Moreover, the actuation mechanism may comprise a pressure chamber at least partly defined between a face of the connection part and a face of the stationary part.

Also, the annular barrier as described above may comprise a second fluid passage for letting fluid into the pressure chamber of the actuation mechanism to push the connection part in the longitudinal direction.

In addition, the second fluid passage may be provided with a check valve.

The annular barrier as described above may further comprise a fluid bypass passage for providing fluid communication between the pressure chamber and the space defined by the expandable sleeve when the connection part has been displaced in the longitudinal direction.

Additionally, the fluid bypass passage may be blocked by the connection part before the connection part is displaced in the longitudinal direction.

In one embodiment, the first fluid passage may be provided in the connection part, thereby fluidly connecting the space defined by the expandable sleeve and the pressure chamber of the actuation mechanism.

By arranging the first fluid passage in the connection part, the flow through the first fluid passage may be adjusted to control the pressure inside the pressure chamber and thus the force induced on the connection part and the first end of the expandable sleeve. By being able to better control the force induced on the connection part, inexpedient thinning of the expandable sleeve may be avoided.

Also, the first fluid passage may be provided with a check valve.

Moreover, the first fluid passage may be provided with a pressure regulated valve preventing fluid flow into the space defined by the expandable sleeve when the pressure inside the space exceeds a predetermined threshold value.

Hereby, rupture of the expandable sleeve may be prevented by the pressure regulated valve because the pressure inside the space is always kept within the limits of the expandable sleeve.

Further, the actuation mechanism described above may comprise a hydraulic pump fluidly connected with the pressure chamber, the hydraulic pump being adapted to push the connection part in the longitudinal direction by pumping a hydraulic fluid into the pressure chamber.

In addition, the actuation mechanism may comprise a pressure-intensifying means comprising an inlet being in fluid communication with the inside of the tubular part and an outlet being in fluid communication with the pressure chamber, whereby a hydraulic fluid is supplied to the pressure chamber to push the connection part in the longitudinal direction.

By the annular barrier comprising a hydraulic pressure intensifier, pressurised fluid inside the tubular part can be used to provide a pressurised fluid inside the pressure chamber at a pressure substantially higher than the pressure of the fluid inside the tubular part. Hereby, the expansion pressure of the hydraulic fluid injected inside the tubular part may be reduced for the benefit of other well hardware deployed in the well.

Moreover, the pressure-intensifying means may further comprise a reciprocating piston and a pilot control valve adapted to change the direction of flow of the hydraulic fluid.

Also, the reciprocating piston of pressure-intensifying means may have a first end face and a second end face, the first end face having a surface area A1 larger than a surface area A2 of the second end face.

Additionally, the surface area of the first end may be between 2 and 6 times larger than the surface area of the second end.

Hereby, the piston is capable of intensifying the pressure applied to the first end face to a higher pressure applied by the second end face on the fluid inside the pressure chamber.

Further, the actuation mechanism may comprise a pressure vessel containing a compressed propellant adapted to push the connection part in the longitudinal direction by providing an excess pressure in the pressure chamber upon activation.

More specifically, the propellant may be nitrogen, neon, argon, krypton, xenon, oxygen or air.

Moreover, the pressure vessel may be activated by a sensor sensing movement of the connection part when the expandable sleeve starts to expand.

Further, the sensor may comprise a shear pin being broken by the movement of the connection part.

In one embodiment, the actuation mechanism may comprise a rod connected with the connection part to push the connection part in the longitudinal direction.

More specifically, the actuation mechanism may comprise a hydraulic pump, the hydraulic pump being adapted to displace the rod by means of hydraulic pressure, whereby the connection part is pushed in the longitudinal direction.

Also, the actuation mechanism may comprise a linear actuator comprising an electrical motor, the linear actuator being adapted to push the connection part in the longitudinal direction.

The linear actuator described above may comprise a spindle rotated by the electrical motor.

In one embodiment, the connection unit may further comprise a piston part slidably connected with the tubular part, the piston part being arranged between the connection part and the stationary part, the pressure chamber being at least partly defined between a face of the piston part and the face of the stationary part, whereby the piston part is adapted to push the connection part in the longitudinal direction.

Hereby, the piston part may be moved in the longitudinal direction away from the connection part without affecting the position of the connection part.

Specifically, the piston part may be connected with the rod.

Also, the piston part may be connected with the linear actuator.

In a further embodiment, the annular barrier may comprise a sensing mechanism adapted to register when the pressure in the tubular part exceeds a predetermined threshold value in order to subsequently activate the actuation mechanism to induce an axial force on the connection part.

Such a sensing mechanism may comprise a rupture disc.

Also, the sensing mechanism may comprise a strain gauge.

Further, the annular barrier may comprise a sensor adapted to register movement of the connection part to activate the actuation mechanism, whereby an axial force is induced on the connection part.

Additionally, the sensor may comprise a shear pin.

Alternatively, the sensor may comprise a magnet contact measuring movement of the connection part.

Also, the sensor may be adapted to measure a pulling force being applied to the connection part.

The present invention further relates to a well system comprising the well tubular structure and the annular barrier as described above.

Finally, the present invention relates to a method for expanding the annular barrier as described above in an annulus between a well tubular structure and an inside wall of a borehole downhole, the method comprising the steps of:

- at least partially expanding the expandable sleeve by letting fluid into the space defined by the expandable sleeve,
- inducing an axial force on the connection part where to one end of the expandable sleeve is connected, and
- expanding the expandable sleeve until the sleeve seals against the inside wall of the borehole.

Also, the method may comprise the step of monitoring the pressure built up inside the space defined by the expandable sleeve.

Further, the axial force may be induced on the expandable sleeve during expansion of the expandable sleeve.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1A:
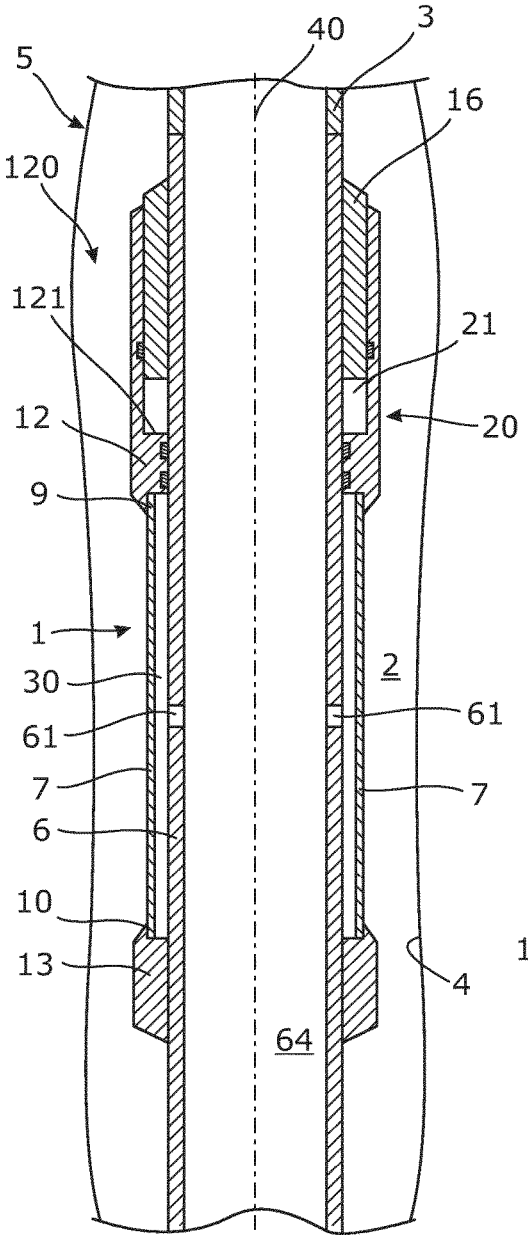
FIG. 1*a* shows an annular barrier with one end of the expandable sleeve being connected to a slidable connection part and the other end being connected to a fixed connection part.

FIG. 1*a* shows an annular barrier 1 to be expanded in an annulus 2 between a well tubular structure 3 and an inside wall 4 of a borehole 5 downhole or an inside wall of another kind of well tubular. The tubular structure 3 may be a production casing. The annular barrier 1 comprises a tubular part 6 mounted as part of the well tubular structure 3. The tubular part 6 has a longitudinal axis 40 coaxial with the longitudinal axis of the well tubular structure 3. The annular barrier 1 comprises an expandable sleeve 7 surrounding the tubular part 6 and defining a space 30 which is in fluid communication with an inside 64 of the tubular part 6. Each end 9, 10 of the expandable sleeve 7 is connected with the tubular part 6, the first end 9 end being slidably fastened in relation to the tubular part and the second end 10 being fixedly fastened in relation to the tubular part by a stationary connection part 13.

The annular barrier 1 has a first fluid passage 61 for letting fluid into the space 30 to expand the expandable sleeve 7, the first fluid passage 61 being arranged in the tubular part 6 so that the fluid is let directly into the space 30. The first fluid passage 61 is for purposes of simplicity only shown in cross section, but it is to be regarded as one or a plurality of first fluid passages arranged around the periphery of the tubular part. A valve, such as a one-way valve, a flow control valve, a pressure-regulating valve, etc, may be arranged in the first fluid passage 61. Further, the annular barrier comprises a connection unit 120 comprising a connection part 12 slidably connecting one end of the expandable sleeve with the tubular part, a stationary part 16 fixedly connected with the tubular part and an actuation mechanism 20 adapted to induce an axial force on the first end of the expandable sleeve in order to prevent unnecessary thinning of the sleeve. The actuation mechanism will be described in more detail below. The first end 9 of the expandable sleeve is connected with the connection part 12 so that the part of the sleeve is moved in the longitudinal direction when the connection part 12 is displaced accordingly.

Figure 1B:
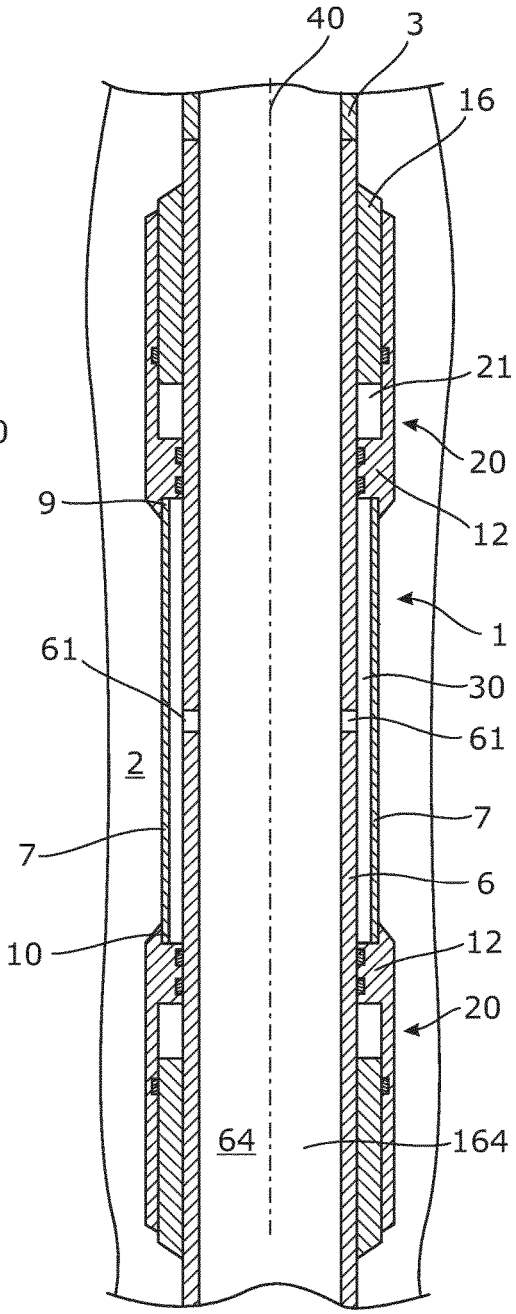
FIG. 1*b* shows an annular barrier with both ends of the expandable sleeve being connected to a connection part slidably connected with the tubular part.

FIG. 1*b* shows another embodiment of an annular barrier wherein each end 9, 10 of the expandable sleeve 7 is slidably fastened in relation to the tubular part 6. This is achieved by the annular barrier comprising two connection units 120 similar to the connection unit described above. Accordingly, the first end 9 and the second end 10 of the expandable sleeve are connected with a slidable connection part 12. In the following, various embodiments of the invention will be disclosed without regard for how each end 9, 10 of the expandable sleeve 7 is connected with the tubular part. Thus, what is disclosed may be applied regardless of whether one or both ends of the expandable sleeve is/are slidably connected with the tubular part.

Figure 13:
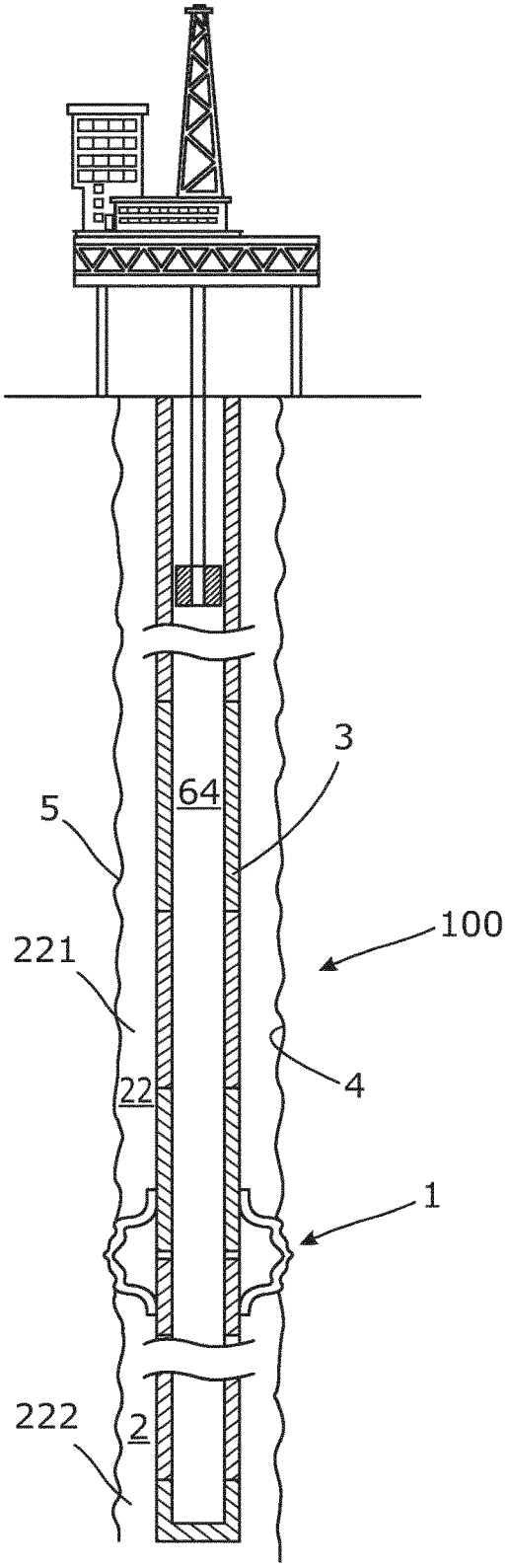
FIG. 13 shows a well system comprising the well tubular structure and the annular barrier.

The annular barrier is mounted as part of a well tubular structure 3 shown in FIG. 13 and activated or set by injecting a hydraulic fluid into the well tubular structure 3. Hereby, the expandable sleeve is expanded in a radial direction by the pressure of the hydraulic fluid, while at the same time one or both ends of the expandable sleeve is moved in the longitudinal direction by a force generated by the actuation mechanism 20.

The fluid may be injected locally in a defined section of the well tubular structure 3 or by pressurising the entire well tubular structure 3. Local injection may be conducted in a number of ways understood by those skilled in the art. One way is to lower a drill pipe with circumferential packers into the well tubular structure and position the packers on opposite sides of the first fluid passages for letting fluid into the space 30 to expand the sleeve. Subsequently, a fluid is injected through the drill pipe into a space between the packers, whereby fluid enters the space through the first fluid passages to activate and set the annular barrier 1.

Another way of conducting local injection is by using a well tool, such as a downhole tractor, comprising a pump. Such a tool may be lowered into the well tubular structure 3 via wireline and be connected directly to the first fluid passage. The well tool may inject fluid already present in the well or fluid carried by the tool.

Figure 2A:
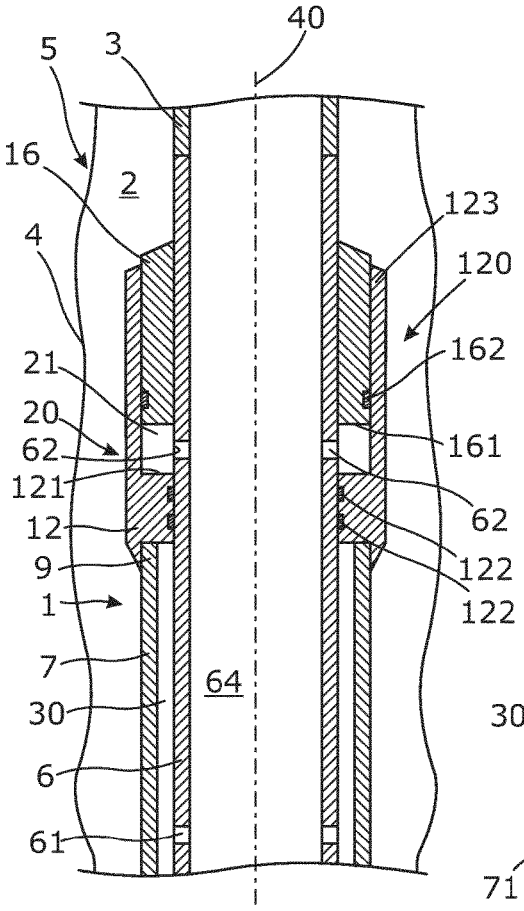
FIG. 2*a* shows a connection unit comprising a pressure chamber and an expandable sleeve when the annular barrier is in an unset condition.
Figure 2B:
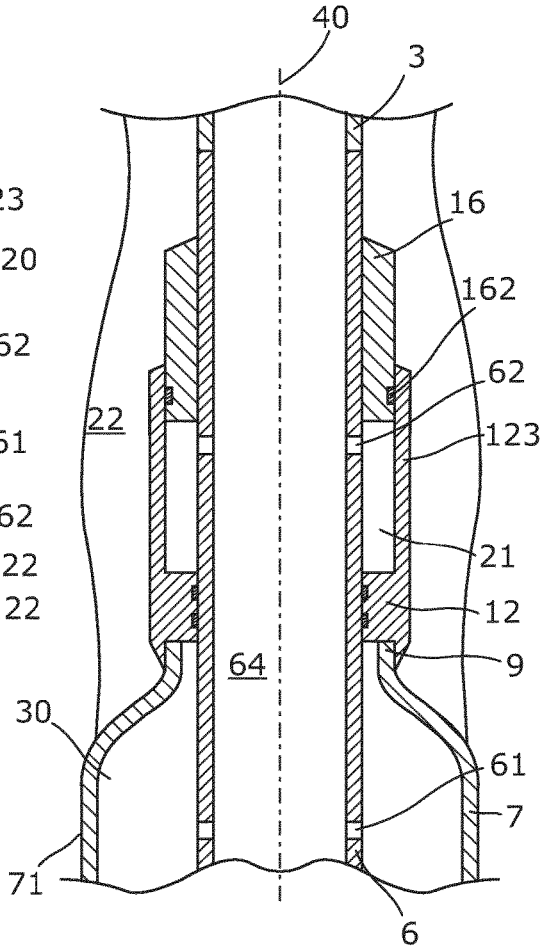
FIG. 2*b* shows the connection unit and the expandable sleeve of the previous figure when the annular barrier is in a set condition.

FIGS. 2*a* and 2*b* show an actuation mechanism comprising a pressure chamber 21. The pressure chamber is positioned between the connection part 12 and the stationary part 16 and is at least partly defined by a face 121 of the connection part and a face 161 of the stationary part. Only a cross section of the actuation mechanism is shown in the figure, but the connection part and the stationary part are to be regarded as revolving parts of a substantially tubular extension and encircling the tubular part 6. However, it is also to be understood by those skilled in the art that the connection part and the stationary part may be divided into a number of individual parts arranged around the periphery of the tubular part while remaining within the scope of the present invention. Thus, the pressure chamber 21 may be one contiguous chamber or be divided into several isolated chambers encircling the tubular part. In the following, reference will only be made to one pressure chamber even though the annular barrier may comprise several independent pressure chambers operated in a uniform way.

The pressure chambers 21 of FIGS. 2*a* and 2*b* are in fluid communication with the inside 64 of the tubular part via second fluid passages 62. When hydraulic fluid is injected into the pressure chamber, a force is exerted on the face 121 of the connection part, whereby the connection part is displaced in the longitudinal direction away from the stationary part 16. To provide a fluid-tight seal between the tubular part 6 and the connection part, one or more sealing members 122, such as o-rings or the like, may be arranged in recesses in the connection part. Similarly, one or more sealing members 162 may be arranged in one or more recesses in the stationary part 16. In the shown embodiment, the connection part 12 comprises a tubular skirt 123 protruding from an end of the connection part opposite the expandable sleeve. The skirt extends to at least partly cover the stationary part 16 and constitutes a wall of the pressure chamber. The tubular skirt 123 slides in relation to the stationary part when the connection part is displaced to prolong the pressure chamber. In FIG. 2*a*, the annular barrier is shown in a deactivated, unset condition, wherein the connection part and the first end of the expandable sleeve have not been displaced. The expandable sleeve is connected with the connection part using techniques understood by those skilled in the art, for which reason this will not be further described.

In FIG. 2*b*, the annular barrier is shown in an activated and set condition, wherein the connection part and the first end of the expandable sleeve have been displaced in the longitudinal direction towards the opposite end of the expandable sleeve and away from the stationary part. The pressure chamber has been considerably prolonged, and an outer face 71 of the expandable sleeve 7 abuts the inside wall 4 of a borehole 5 downhole or, alternatively, an inside wall of another well tubular structure. Thereby, a section 22 of the annulus surrounding the tubular structure 3 is isolated from the remainder of the annulus 2. A first zone 221 of the borehole is thus isolated from a second zone 222 of the borehole, as shown in FIG. 13.

By simultaneously injecting a hydraulic fluid into the space defined by the expandable sleeve and displacing the connection part to move at least one end of the expandable sleeve towards the other end, inexpedient thinning of the expandable sleeve is avoided. The degree of displacement of the connection part is balanced according to the size of the expandable sleeve, material properties, desired expanded diameter of the expandable sleeve, etc.

When the annular barrier is in a set condition, the connection part 12 may be permanently or temporarily locked in the displaced position, as show in FIG. 2*b*, by locking means (not shown in FIG. 2*b*) known by those skilled in the art.

Figure 3A:
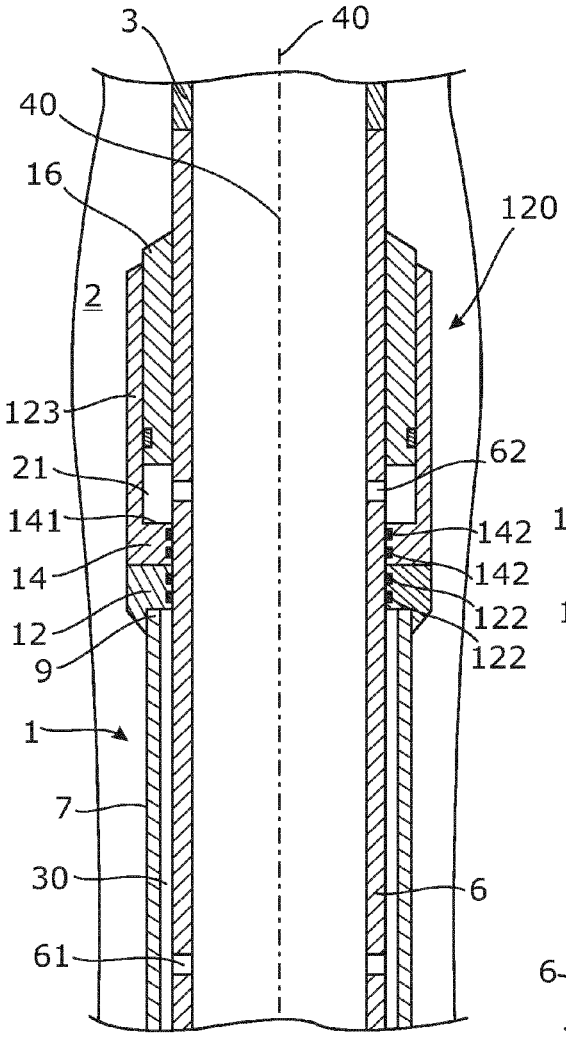
FIG. 3*a* shows a connection unit comprising a connection part and a piston part and an expandable sleeve when the annular barrier is in an unset condition.

FIG. 3*a* shows a connection unit 120 comprising both the connection part 12 and a piston part 14. In this embodiment, the expandable sleeve is connected with the connection part, and a face 141 of the piston partly defines the pressure chamber 21. Further, the piston part comprises a tubular skirt 123 similar to that of the connection part 12 described above. Both the connection part and the piston part comprise sealing members 122, 142 for providing a fluid-tight connection to the tubular part. The pressure chamber 21 has a functionality similar to that of the pressure chamber described above, and when hydraulic fluid is injected into the pressure chamber 21 via the second fluid passages 62, a force is exerted on the face 141 of the piston part. Hereby, the piston part is displaced in the longitudinal direction away from the stationary part 16, whereby the connection part is also displaced in the longitudinal direction.

Figure 3B:
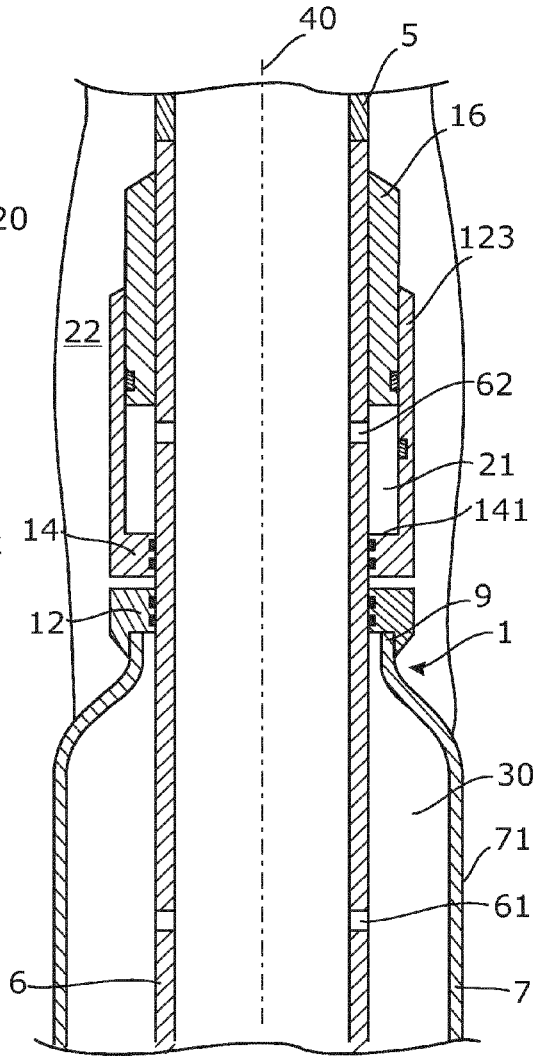
FIG. 3*b* shows the connection unit and the expandable sleeve of the previous figure when the annular barrier is in a set condition.

As shown in FIG. 3*b*, the piston part and the connection part are not interconnected. Thus, the piston part can only affect the movement of the connection part in the longitudinal direction away from the stationary part. By the piston part and the connection part not being connected, the piston part and hence the actuation mechanism may be displaced after the annular barrier has been set, without affecting the position of the connection part and the expansion of the expandable sleeve.

Figure 4A:
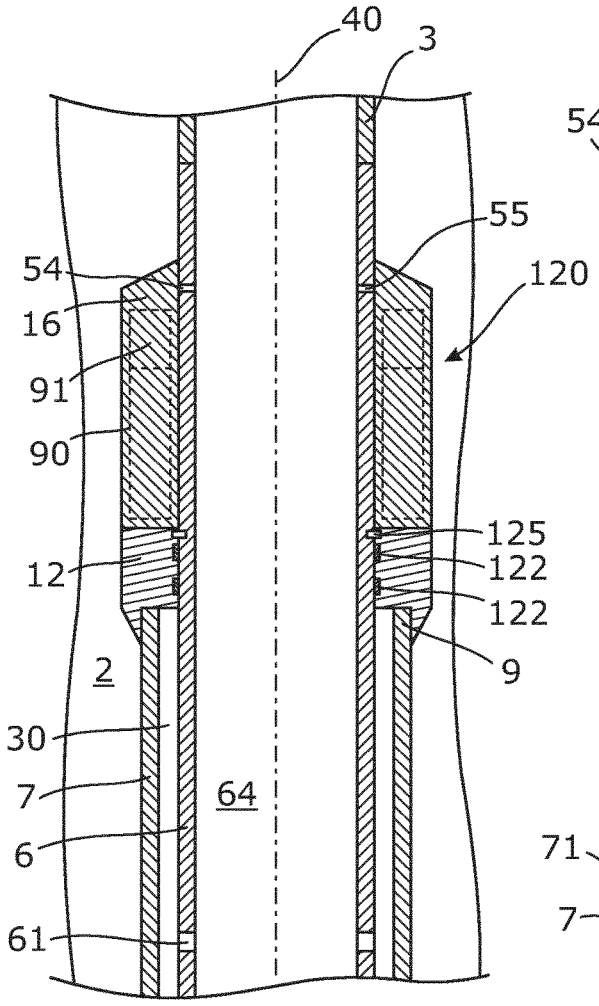
FIG. 4*a* shows a connection unit comprising a rod and an expandable sleeve when the annular barrier is in an unset condition.
Figure 4B:
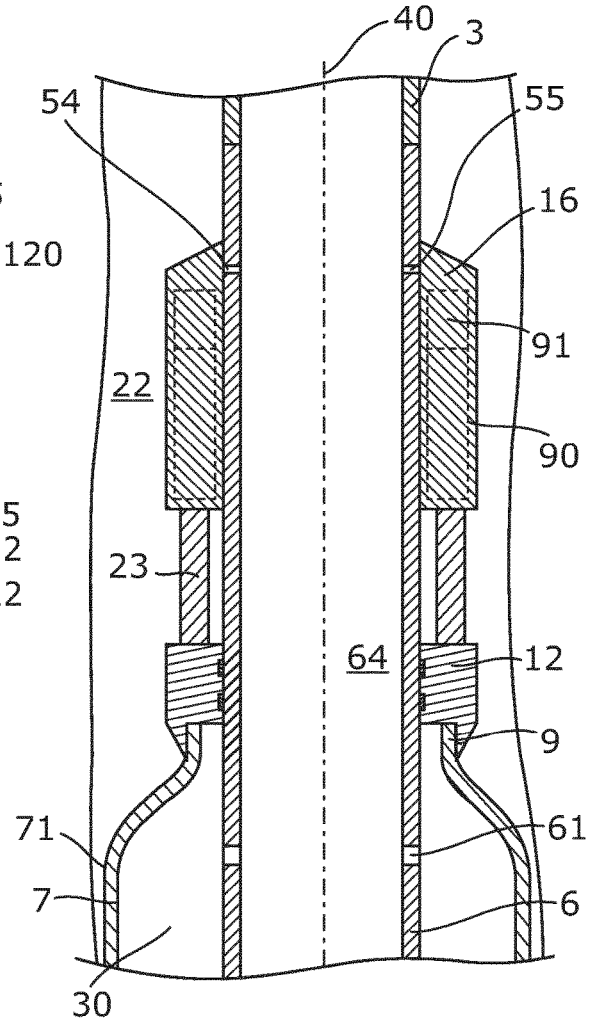
FIG. 4*b* shows the connection unit and the expandable sleeve of the previous figure when the annular barrier is in a set condition.

In FIGS. 4*a* and 4*b*, a connection unit 120 comprising a rod 23 connected to the connection 12 part is shown. The rod extends from the stationary part 16 to displace the connection part 12 in the longitudinal direction. The rod may be a revolving part of substantially tubular extension, encircling the tubular part 6. However, the annular barrier may alternatively comprise a number of individual rods arranged around the periphery of the tubular part. In one embodiment, the actuation mechanism for displacing the rods is comprised by a linear actuator 90, and the rod 23 is constructed as a spindle displaced by an electrical motor 91. However, as would be understood by those skilled in the art, a rod may be displaced in a number of other ways which are considered to be within the scope of the present invention.

Figure 12:
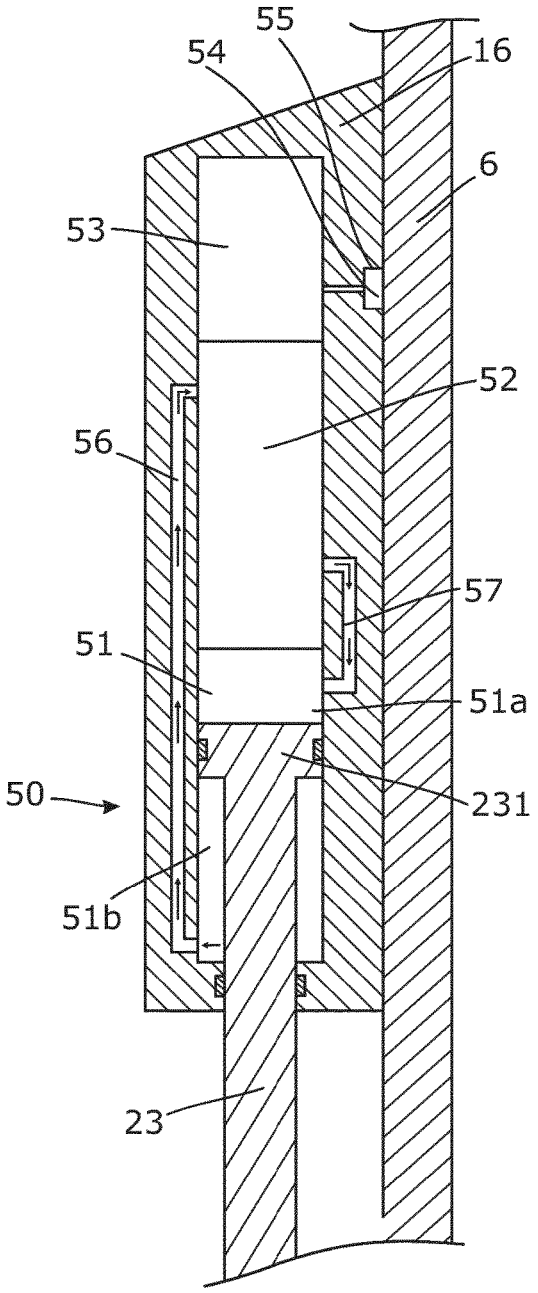
FIG. 12 shows a schematic illustration of a connection comprising a hydraulic piston adapted to displace the connection part in the longitudinal direction.

In an alternative embodiment, the one or more rods are displaceable in the longitudinal direction using one or more hydraulic mechanisms 50, as shown in FIG. 12. The hydraulic mechanism comprises a piston chamber 51, a hydraulic pump 52 and control electronics 53 for controlling the operation of the hydraulic pump. One end of the rod, opposite the end of the rod connected to the connection part (not shown in FIG. 12), is provided with a piston 231 arranged in the piston chamber 51. The piston 231 divides the piston chamber into a first chamber section 51*a* and a second chamber section 51*b*. Upon activation, the hydraulic pump pumps fluid from the second chamber section 51*b* into the first chamber section 51*a* via a conduit 56. Hereby, the rod 23 and accompanying piston 231 are displaced by the hydraulic fluid towards the left when regarded as shown in FIG. 12. As the rod 23 is displaced, the connection part 12 and the first end of the expandable sleeve 7 are displaced in the longitudinal direction towards the other end of the expandable sleeve 7 (shown in FIG. 1*a*), whereby the expandable sleeve is compressed. If, for some reason, retrieval of the connection part is necessary, the hydraulic pump may be controlled to reverse the fluid stream and pump hydraulic fluid from the first chamber section 51*a* and into the second chamber section 51*b* via the conduit 57. Hereby, the rod 23 and accompanying piston 231 are displaced by the hydraulic fluid towards the right when regarded, as shown in FIG. 12. In the shown embodiment, the hydraulic mechanism 50 is capable of moving both forwards and backwards. In an alternative embodiment, the hydraulic mechanism may, however, be designed only with forward motion in mind, eliminating the option of moving in two directions. The hydraulic pump is controlled by the control electronics 53 comprising a sensing mechanism 54, such as a pressure sensor, strain gauge, rupture disc, etc., for sensing the pressure inside the tubular part. The sensing mechanism communicates with the inside of the tubular part and may be arranged in a recess or an opening 55 in the wall of the tubular part or by any other means known to those skilled in the art. When the control electronics receive a signal from the sensing mechanism that the pressure in the tubular part has exceeded a certain threshold value, indicating that hydraulic fluid is being injected into the well to expand the expandable sleeve, the control electronics activates the pump to pump fluid from the second chamber section 51*b* into the first chamber section 51*a*. The expandable sleeve is thus both expanded by hydraulic fluid being injected into the space 30 and compressed by the movement of the connection part.

Figure 5:
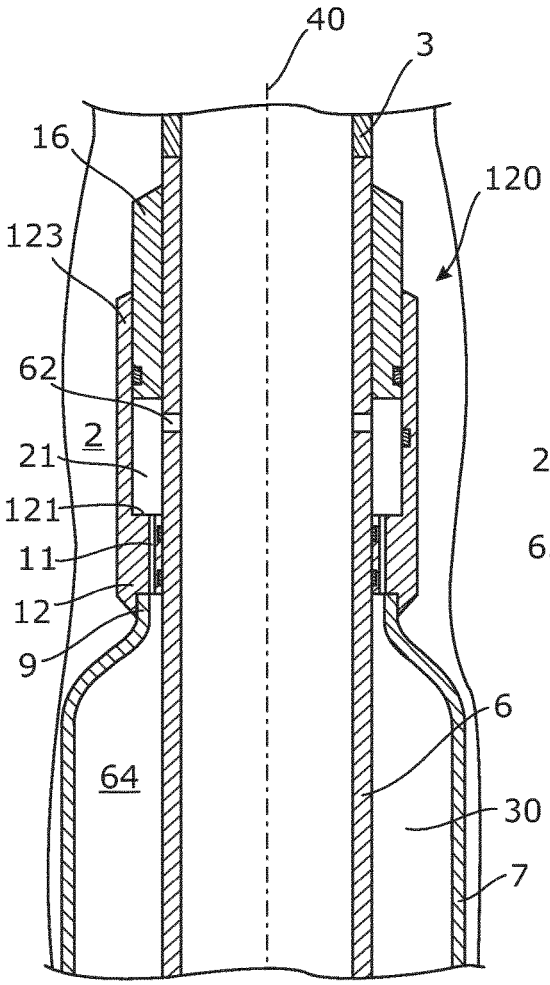
FIG. 5 shows a connection unit comprising a fluid passage providing fluid communication between the pressure chamber and the space defined by the expandable sleeve.

FIG. 5 shows an embodiment similar to what is shown in FIGS. 2*a* and 2*b*, the only difference being that a first fluid passage 11 is provided in the connection part 12. The first fluid passage 11 provides fluid communication between the pressure chamber 21 and the space 30 defined by the expandable sleeve. Hereby, the hydraulic fluid for expanding the expandable sleeve is provided through the pressure chamber 21. The first fluid passage 11 is for purposes of simplicity only shown in cross section, but it is to be regarded as one or a plurality of first fluid passages arranged in a substantially circular pattern in one or more connection parts 12 surrounding the tubular part. By arranging the first fluid passage 11 in the connection part, the flow through the first fluid passage 11 may be adjusted to control the pressure inside the pressure chamber 21 and thus the force induced on the connection part 12 and the first end of the expandable sleeve 7. The flow through the first fluid passage may be controlled by varying the cross-sectional size of the first fluid passages or by providing flow regulating means known to those skilled in the art in the first fluid passage.

Figure 6:
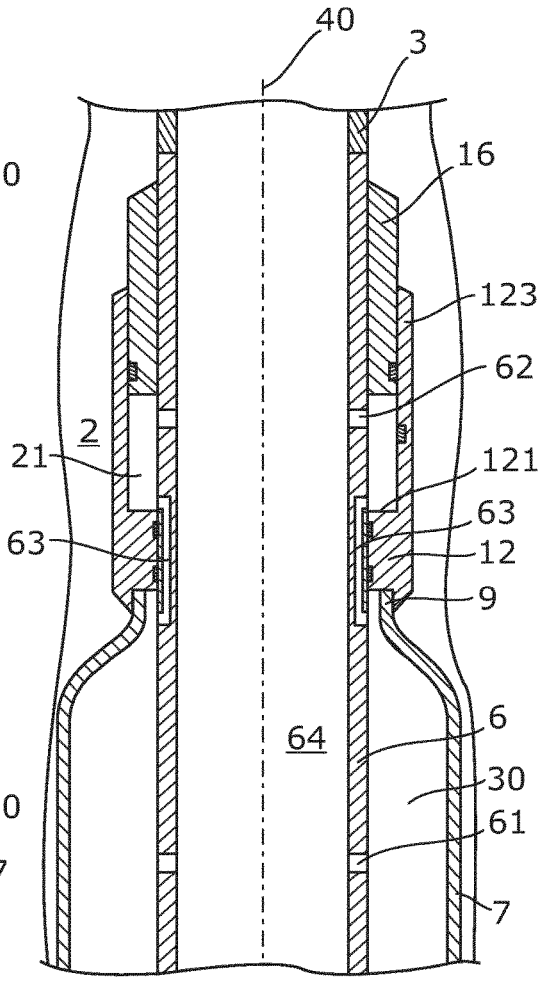
FIG. 6 shows a fluid bypass passage for providing fluid communication between the pressure chamber and the space defined by the expandable sleeve.

Referring to FIG. 6, an embodiment comprising a fluid bypass passage 63 is shown. In its initial position, the connection part 12 blocks the fluid bypass passage 63 until a certain pressure is built up inside the pressure chamber, which is sufficient to move the connection part 12 to the position shown in FIG. 6. In FIG. 6, the fluid bypass passage 63 provides fluid communication between the pressure chamber and the space defined by the expandable sleeve when the connection part 12 has been displaced a certain distance away from the stationary part 16. Hereby, the hydraulic fluid injected into the pressure chamber 21 will bypass the connection part 12, and the force induced by the hydraulic fluid on the face 121 of the connection part will be reduced, and the displacement of the connection part will stop. Also, a physical stop (not shown) may be provided on the outer face of the tubular part to restrict further displacement of the connection part if the first end of the expandable sleeve should only be displaced a certain distance towards the opposite end. As would be understood by those skilled in the art, a physical stop may be constructed in a number of different ways without departing from the scope of the invention.

Figure 7:
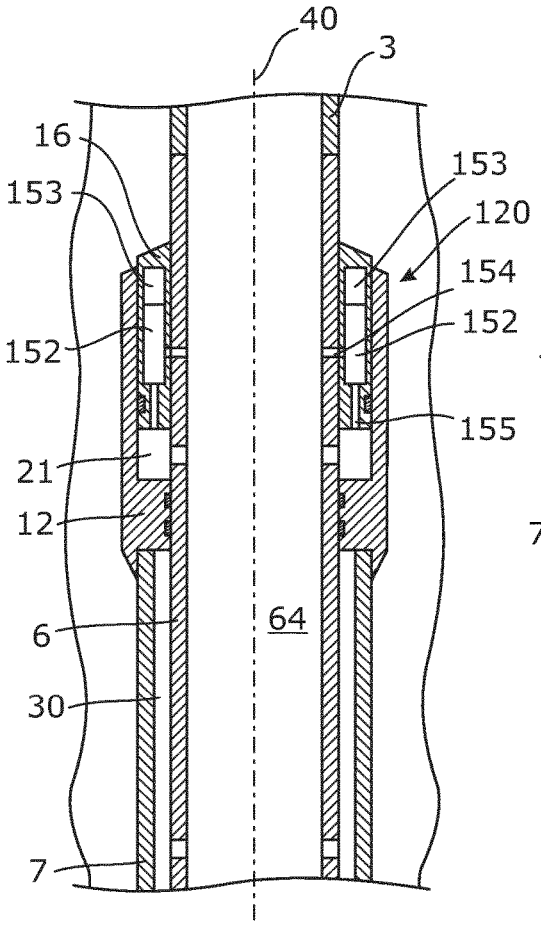
FIG. 7 shows a connection unit comprising a hydraulic pump adapted to pump a hydraulic fluid into the pressure chamber.

FIG. 7 shows an annular barrier comprising a hydraulic pump 152 fluidly connected with the inside of the tubular part and comprising control electronics 153 for controlling the operation of the hydraulic pump. The hydraulic pump and the control electronics constitute the actuation mechanism, and upon activation, the hydraulic pump draws fluid from the inside of the tubular part via an opening 154 and pumps the fluid into the pressure chamber 21 via an inlet 155. Hereby, the connection part 12 is displaced by the hydraulic fluid to push the first end of the expandable sleeve 7 in the longitudinal direction towards the other end of the expandable sleeve 7 (shown in FIG. 1*a*). The control electronics may control the hydraulic pump 152 in a manner similar to the control of the hydraulic pump 52 described above.

Figure 8:
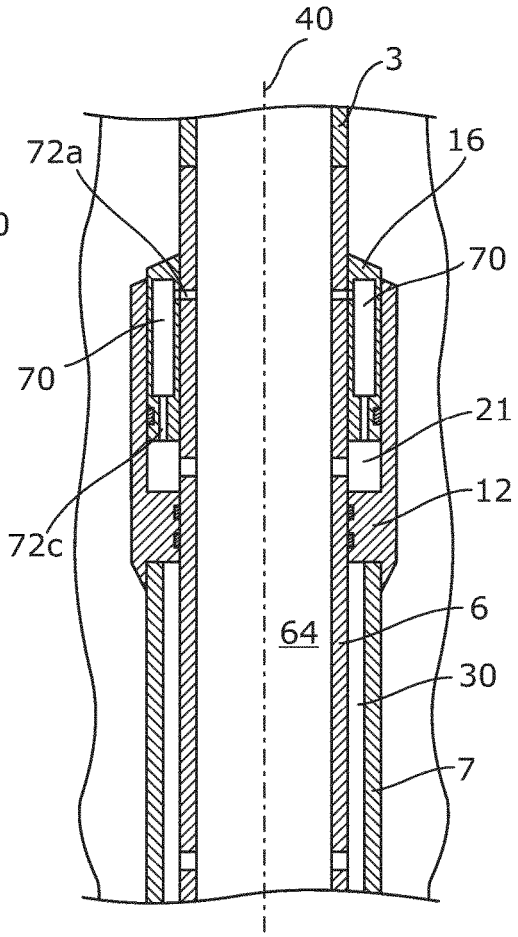
FIG. 8 shows a connection unit comprising a pressure intensifier adapted to supply a hydraulic fluid into the pressure chamber.

Referring to FIG. 8, a connection unit comprising a pressure-intensifying means in the form of a hydraulic pressure intensifier 70 is shown. By the annular barrier comprising a hydraulic pressure intensifier 70, pressurised fluid inside the tubular part can be used to provide a pressurised fluid inside the pressure chamber 21 having a pressure substantially higher than the pressure of the fluid inside the tubular part. Hereby, the expansion pressure of the hydraulic fluid injected inside the tubular part may be substantially reduced for the benefit of other well hardware components deployed in the well. The hydraulic pressure intensifier is in fluid communication with the inside of the tubular part, as shown in FIG. 11.

Figure 11:
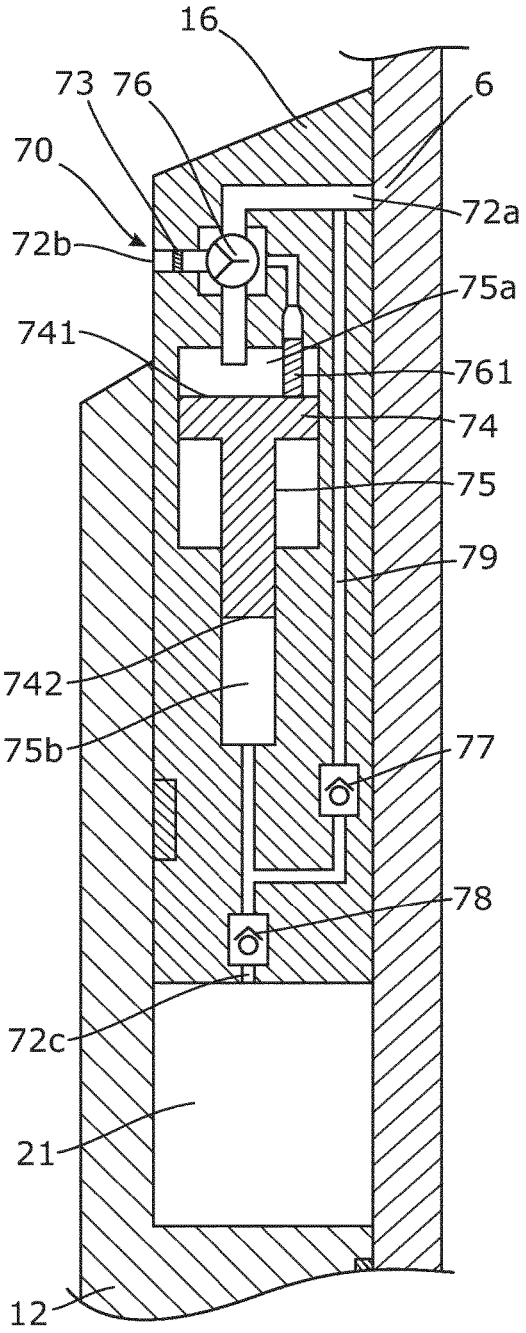
FIG. 11 shows a schematic illustration of the connection unit comprising the pressure intensifier shown in FIG. 8.

FIG. 11 shows a diagram of an embodiment of a hydraulic pressure intensifier. The hydraulic pressure intensifier 70 comprises a piston 74 being slidably arranged within a piston housing 75. The piston has a first end face 741 and a second end face 742, and the first end face 741 has a surface area A1 larger than a second end surface area A2 of the second end face 742. Hereby, the piston 74 is capable of intensifying the pressure applied to the first end face 741 to a higher pressure applied by the second end face 742 on the fluid inside a second space 75*b* of the piston housing 75. Further, the hydraulic pressure intensifier comprises a pilot control valve 76 for controlling fluid communication between a first space 75*a*, an inlet 72*a* of the pressure intensifier and an excess fluid outlet 72*b*, providing fluid communication from the pressure intensifier to the borehole when the piston is retracted for letting a new amount of fluid into a second space 75*b*. The pilot control valve has two positions. The first position allows fluid communication between the first space 75*a* and the inlet 72*a* for providing fluid in the first space 75*a* during pressurisation. The second position allows fluid communication between the first space 75*a* and the excess fluid outlet 72*b* during retraction of the piston.

The pilot control valve may automatically be switched between said first position and second position by a pilot 761 when the piston reaches its extreme positions in either end of the piston housing. Furthermore, the pressure-intensifying means may comprise a first one-way check valve 77 and a second one-way check valve 78. The first one-way check valve 77 allows fluid to flow from the inlet 72*a* into the second space 75*b*, but prevents the pressure-intensified fluid exiting the second space 75*b* from flowing back towards the inlet 72*a*. In this way, the high pressure side of the pressure intensifier may be fed with fluid from the inlet during retraction of the piston. The second one-way check valve 78 allows pressure-intensified fluid to flow from the second space 75*b* towards an outlet 72*c* of the pressure intensifier and into the pressure chamber 21, but prevents the fluid inside the pressure chamber 21 from flowing back towards the second space 75*b* during retraction of the piston, where the second space 75*b* is filled with lower pressure fluid.

In order to prevent fluids containing dirty particles from entering the pressure intensifier through the excess fluid outlet 72*b*, typically a filter 73 will be arranged in the excess fluid outlet. During normal operation of the pressure intensifier, fluid will only exit the excess fluid connection into the borehole, but under special circumstances, such as high pressure fluctuations in the borehole, the filter may be expedient.

It is to be understood by those skilled in the art that many different designs and variations of a hydraulic pressure intensifier may be implemented in the annular barrier, and such designs and variations are considered to be within the scope of the present invention.

Figure 9:
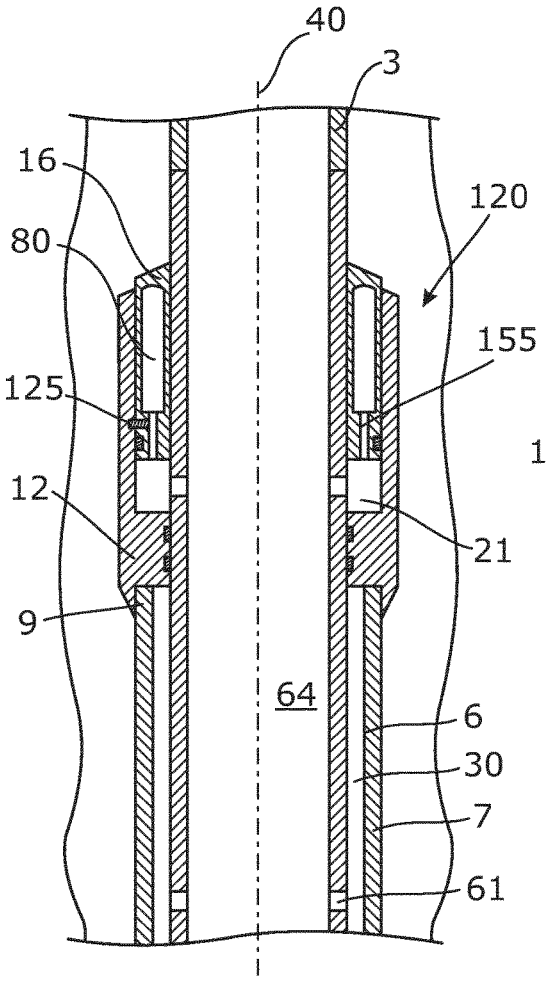
FIG. 9 shows a connection unit comprising a pressure vessel adapted to push the connection part in the longitudinal direction.

FIG. 9 shows an annular barrier wherein a pressure vessel 80 is comprised in the actuation mechanism 20. The pressure vessel 80 is arranged in the stationary part 16 of the connection unit 120 and contains a compressed propellant adapted to push the connection part 12 in the longitudinal direction by providing an excess pressure in the pressure chamber 21. The propellant is supplied to the pressure chamber 21 via the inlet 155 upon activation of the pressure vessel 80. The pressure vessel 80 is activated when the pressure in the tubular part 6 has exceeded a certain threshold value, indicating that hydraulic fluid is being injected into the well to expand the expandable sleeve 7. Activation of the pressure vessel 80 may be controlled in a number of different ways understood by those skilled in the art. In one embodiment, a shear pin 125 or contact is provided to register when the expandable sleeve is expanded by the fluid pressure and the connection part 12 is under the influence of a pulling force from the expandable sleeve. When this occurs, the propellant inside the pressure vessel is released to boost the longitudinal movement of the connection part and the first end of the expandable sleeve. Alternatively, the pressure vessel 80 may be activated upon receiving a signal from a sensing mechanism, such as described in the foregoing embodiments.

Figure 10:
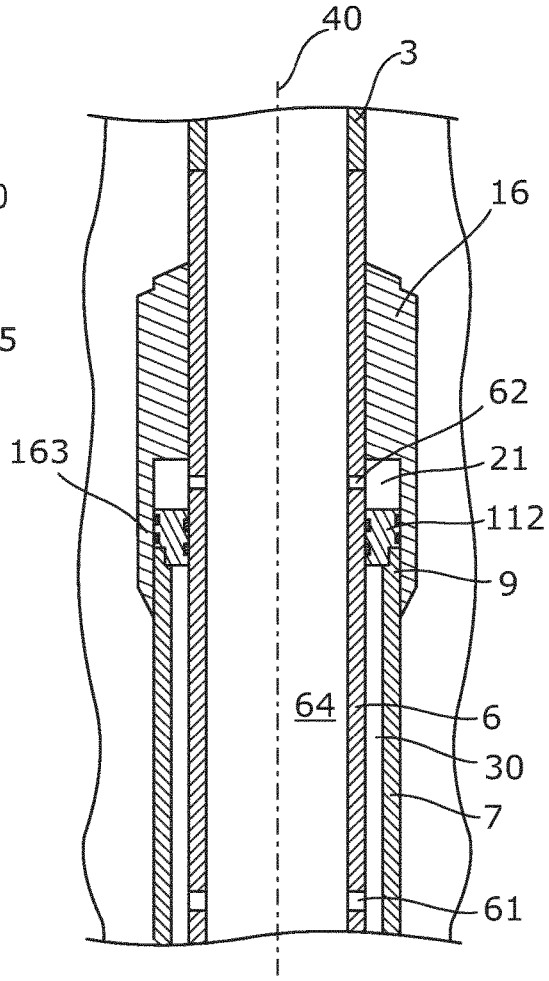
FIG. 10 shows another embodiment of a connection unit comprising a connection part slidably connected with the tubular part.

FIG. 10 shows a connection unit 120 comprising a connection part 112 slidably connected with the tubular part 6. The stationary part 16 comprises a tubular skirt 163 protruding from an end of the connection part 12, encircling the tubular part 6. The skirt and the tubular part define a housing wherein the connection part 112 may slide in the longitudinal direction. The tubular part 6, the stationary part 16 and the connection part 112 together define the pressure chamber 21 being fluidly connected to the inside of the tubular part 6 via the second fluid passage 62. When hydraulic fluid is injected into the pressure chamber 21, the connection part 112 and the first end 9 of the expandable sleeve 7 connected to the connection part 112 slide in the housing in the longitudinal direction.

Any of the various embodiments of an annular barrier described above may comprise one or more shear pins 125, as the one shown in FIGS. 4*a* and 9. The shear pin 125 restricts unintended displacement of the connection part and the first end 9 of the expandable sleeve 7. When the annular barrier is inserted into the well, unintentional expansion of the expandable sleeve should for example be avoided in order to prevent the annular barrier from getting stuck in the well. The shear pin is only shown as an exemplary embodiment, and those skilled in the art would know that many other configurations of a shear pin may be provided without departing from the scope of the invention.

Referring to FIG. 13, a well system 100 comprising the well tubular structure 3 and the annular barrier 1 is shown. The tubular part 6 of the annular barrier 1 is connected with other casing sections to constitute the well tubular structure 3, and when positioned in the well, the annular barrier 1 is expanded, as shown in FIG. 13. Hereby, a section 22 of the annulus surrounding the tubular structure 3 is isolated from the remainder of the annulus 2. A first zone 221 of the borehole is thus isolated from a second zone 222 of the borehole, as shown in FIG. 13.

The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognised that the different teachings of the different embodiments discussed above may be employed separately or in any suitable combination to produce desired results.

An annular barrier may also be called a packer or similar expandable means. The well tubular structure can be the production tubing or casing or a similar kind of tubing downhole in a well or a borehole. As mentioned earlier, the annular barrier can be used both in between the inner production tubing and an outer tubing in the borehole or between a tubing and the inner wall of the borehole. A well may have several kinds of tubing and the annular barrier of the present invention can be mounted for use in all of them.

The valves that may be utilised to control the flow through the first and second fluid passages may be any kind of valve capable of controlling flow, such as a ball valve, butterfly valve, choke valve, check valve or non-return valve, diaphragm valve, expansion valve, gate valve, globe valve, knife valve, needle valve, piston valve, pinch valve or plug valve.

The expandable tubular metal sleeve may be a cold-drawn or hot-drawn tubular structure.

The fluid used for expanding the expandable sleeve may be any kind of well fluid present in the borehole surrounding the tool and/or the well tubular structure 3. Also, the fluid may be cement, gas, water, polymers, or a two-component compound, such as powder or particles mixing or reacting with a binding or hardening agent. Part of the fluid, such as the hardening agent, may be present in the cavity between the tubular part and the expandable sleeve before injecting a subsequent fluid into the cavity.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tools are not submergible all the way into the casing, a downhole tractor can be used to push the tools all the way into position in the well. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. An annular barrier to be expanded in an annulus between a well tubular structure and an inside wall of a borehole downhole for providing zone isolation between a first zone and a second zone of the borehole, the annular barrier comprising:

a tubular part extending in a longitudinal direction for mounting as part of the well tubular structure, an expandable metal sleeve surrounding the tubular part and defining a space being in fluid communication with an inside of the tubular part, a first fluid passage for letting fluid into the space to expand the sleeve, and a connection unit comprising:

a connection part slidably connected with the tubular part, a first end of the expandable sleeve being connected with the connection part, a stationary part fixedly connected with the tubular part, and an actuation mechanism adapted to induce an axial force on the first end of the expandable sleeve, whereby the connection part is displaced in the longitudinal direction towards a second end of the expandable sleeve connected with the tubular part, wherein the actuation mechanism further comprises a pressure chamber at least partly defined between a face of the connection part and a face of the stationary part, and a second fluid passage for letting fluid into the pressure chamber to push the connection part in the longitudinal direction, and wherein the first fluid passage is provided in the connection part, thereby fluidly connecting the space defined by the expandable sleeve and the pressure chamber.

2. An annular barrier according to claim 1, comprising two connection units, each comprising the connection part connected to a first and a second end of the expandable metal sleeve, respectively.

3. An annular barrier according to claim 1, wherein said first fluid passage forms a fluid bypass passage for providing fluid communication between the pressure chamber and the space defined by the expandable metal sleeve only when the connection part has been displaced in the longitudinal direction.

4. An annular barrier according to claim 1, wherein the first fluid passage comprises a plurality of first fluid passages.

5. An annular barrier according to claim 1, wherein the first fluid passage provided in the connection part is positioned radially outwards of the part of the connection part that is sealed against the tubular part.

6. An annular barrier according to claim 1, wherein the first end of the metal sleeve is spaced radially outward from the tubular part and the first fluid passage.

7. An annular barrier according to claim 1, wherein an inner surface of the first end of the metal sleeve is spaced radially outward from the first fluid passage.

8. An annular barrier according to claim 1, wherein the metal sleeve is expandable from an uninflated state to a permanent, set inflated state upon the application of pressurized fluid to the space.

9. A well system comprising the well tubular structure and the annular barrier according to claim 1.

10. A method for expanding an annular barrier according to claim 1, in an annulus between a well tubular structure and an inside wall of a borehole downhole, the method comprising:

at least partly expanding the expandable metal sleeve by letting fluid into the space defined by the expandable metal sleeve, inducing an axial force on the connection part whereto one end of the expandable metal sleeve is connected, and expanding the expandable metal sleeve until the sleeve seals against the inside wall of the borehole.

* * * * *